US005860559A

United States Patent [19]

Wang

[11] Patent Number: 5,860,559

[45] Date of Patent: Jan. 19, 1999

[54] HEAT INSULATED CUP HOLDER

[76] Inventor: Ming Yuan Wang, 11, Paosheng 2nd Hsiang, Chihkean S. Rd., Tzukuang Hsiang, Kaohsiung Hsien, Taiwan

[21] Appl. No.: 78,590

[22] Filed: May 13, 1998

[51] Int. Cl.[6] ..... B65D 51/00

[52] U.S. Cl. ..... 220/737; 220/632; 220/738

[58] Field of Search ..... 220/737, 738, 220/632; 229/400; 248/154, 314

[56] References Cited

U.S. PATENT DOCUMENTS

| | | | |
|---|---|---|---|
| 645,626 | 3/1900 | Mills | 220/737 X |
| 2,050,909 | 8/1936 | Woodall | 220/737 X |
| 2,483,168 | 9/1949 | Amberg | 220/738 X |
| 3,232,512 | 2/1966 | Wanderer | 220/737 X |
| 4,767,015 | 8/1988 | Ho | 220/632 X |
| 4,919,381 | 4/1990 | Buist | 220/738 X |
| 5,123,558 | 6/1992 | Moloney | 220/737 X |
| 5,158,193 | 10/1992 | Chen | 220/632 X |

*Primary Examiner*—Steven M. Pollard
*Attorney, Agent, or Firm*—Pro-Techtor International Services

[57] ABSTRACT

A heat insulative cup holder includes a cup-like holder base, a plurality of springy retaining members fastened to lugs inside the holder base for holding down a cup in the holder base by, and an anti-skid rubber packing ring mounted in an outside annular groove on the holder base for supporting it on a flat surface.

1 Claim, 2 Drawing Sheets

HEAT INSULATED CUP HOLDER

BACKGROUND OF THE INVENTION

The present invention relates to a cup holder, and more particularly to a heat insulative cup holder specifically designed for holding a paper cup on a flat surface.

A paper cup tends to be deformed when compressed with the hand. When a paper cup is used to hold hot water or the like, the paper cup must be handled with care, and a paper cup pad may be used to hold the paper cup in order not to let heat be transmitted to the hand. However, the paper cup may fall from the cup pad when the cup pad or the table on which the cup pad is placed is vibrated by a force.

SUMMARY OF THE INVENTION

It is one object of the present invention to provide a cup holder which is specifically designed for holding a paper cup. It is another object of the present invention to provide a cup holder which is inexpensive. It is still another object of the present invention to provide a cup holder which effectively stops the transmission of heat from the cup held therein to the user's hand. According to one aspect of the present invention, springy retaining members are provided inside the cup holder for holding down a cup inserted therein. According to another aspect of the present invention, an anti-skid packing ring is provided at the bottom surface of the cup holder for supporting the cup holder stably on a flat surface.

DETAILED DESCRIPTION OF THE PREFERRED EMBODIMENT

Figure 1:
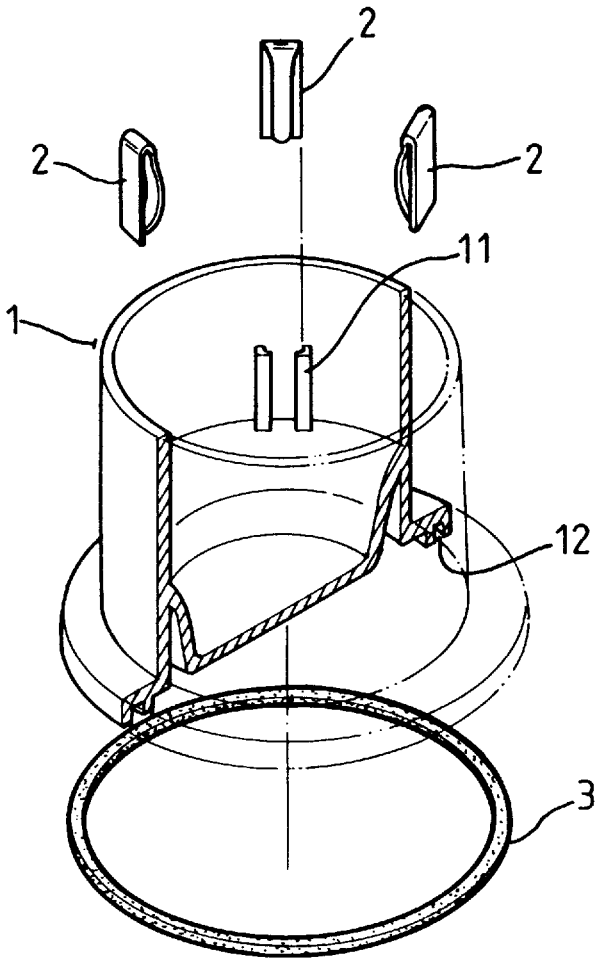
FIG. 1 is an exploded view of a heat insulative cup holder according to the present invention.
Figure 2:
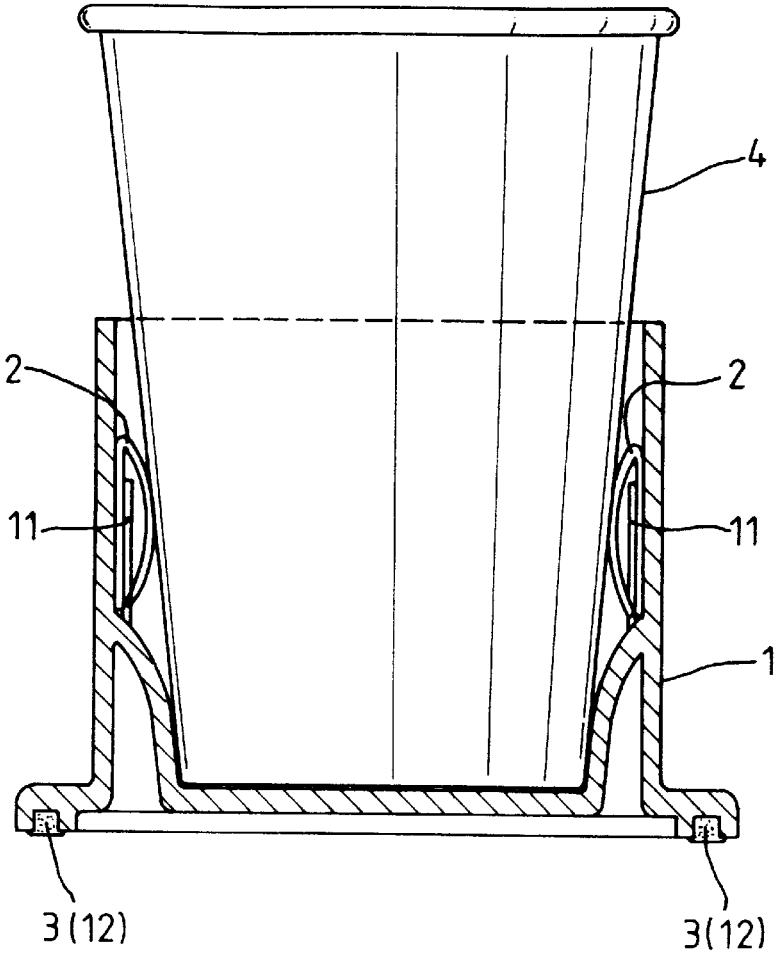
FIG. 2 is a sectional view of the present invention, showing a cup inserted in the holder base.
Figure 3:
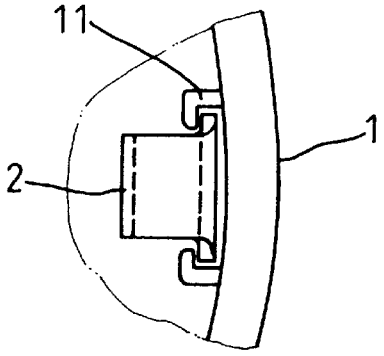
FIG. 3 is a sectional view of a part of the present invention, showing the springy retaining member fastened to the lugs.

Referring to FIGS. 1 and 2, a heat insulative cup holder in accordance with the present invention is generally comprised of a cup-like holder base 1, a plurality of retaining members 2, and an anti-skid packing ring 3.

The holder base 1 comprises equiangularly spaced pairs of lugs 11 raised from the inside wall thereof, and an annular groove 12 provided at the bottom surface thereof along the border. The retaining members 2 are springy, and respectively fastened to the lugs 11 inside the holder base 1. When a paper cup 4 is inserted into the holder space defined within the holder base 1, the retaining members 2 impart an inward pressure to the periphery of the paper cup 4, causing the paper cup 4 to be retained in the holder base 1. The anti-skid packing ring 3 is a rubber ring mounted in the annular groove 12 at the bottom surface of the holder base 1. When the holder base 1 is placed on a flat surface for example the top plate of a table, the rubber packing ring 3 is peripherally retained in close contact with the top plate of the table, enabling the holder base 1 to be firmly supported on the top plate of the table. Because the paper cup 4 is retained in the holder base 4 by the spring power of the retaining members 2, the paper cup 4 can easily be removed from the holder base 4 by an upward pulling force which surpasses the spring power of the retaining members 2.

While only one embodiment of the present invention has been shown and described, it will be understood that various modifications and changes could be made thereunto without departing from the spirit and scope of the invention disclosed.

What the invention claimed is:

1. A heat insulative cup holder comprising:

a heat insulative holder base defining a holding space for holding a cup, said holder base comprising equiangularly spaced pairs of lugs raised from an inside wall thereof within said holding space, and an outside annular groove at a bottom surface thereof;

a plurality of springy retaining members respectively fastened to said lugs for stopping against the periphery of a cup inserted into the holding space within said holder base to hold the inserted cup in place; and a rubber packing ring mounted in the outside annular groove on said holder base for supporting said holder base on a flat surface.

* * * * *